US010675746B2

(12) United States Patent
Burger

(10) Patent No.: US 10,675,746 B2
(45) Date of Patent: Jun. 9, 2020

(54) HAND-HELD POWER TOOL HOUSING

(71) Applicant: Hilti Aktiengesellschaft, Schaan (LI)

(72) Inventor: Helmut Burger, Prittriching (DE)

(73) Assignee: Hilti Aktiengesellschaft, Schaan (LI)

( * ) Notice: Subject to any disclaimer, the term of this patent is extended or adjusted under 35 U.S.C. 154(b) by 275 days.

(21) Appl. No.: 15/575,259

(22) PCT Filed: May 20, 2016

(86) PCT No.: PCT/EP2016/061398
§ 371 (c)(1),
(2) Date: Nov. 17, 2017

(87) PCT Pub. No.: WO2016/188891
PCT Pub. Date: Jan. 12, 2016

(65) Prior Publication Data

US 2018/0133885 A1 May 17, 2018

(30) Foreign Application Priority Data

May 27, 2015 (EP) ..... 15169325

(51) Int. Cl.
*B25F 5/02* (2006.01)

(52) U.S. Cl.
CPC ..... *B25F 5/02* (2013.01)

(58) Field of Classification Search
CPC ... B25F 5/02; B25D 2250/121; B23B 45/001; B29C 66/10; B29C 66/128;
(Continued)

(56) References Cited

U.S. PATENT DOCUMENTS 5,565,719 A 10/1996 Kuhlmann
5,797,925 A * 8/1998 Heintke ..... A45D 26/00 606/131
(Continued)

FOREIGN PATENT DOCUMENTS

DE 42 26 903 A1 2/1994
DE 200 00 230 U1 6/2001
(Continued)

OTHER PUBLICATIONS

PCT/EP2016/061398, International Search Report (PCT/ISA/210 and PCT/ISA/220) dated Aug. 26, 2016, with partial English translation, enclosing Written Opinion of the International Searching Authority (PCT/ISA/237) (Fourteen (14) pages).

*Primary Examiner* — Hemant Desai
*Assistant Examiner* — James E Van Loon
(74) *Attorney, Agent, or Firm* — Crowell & Moring LLP

(57) ABSTRACT

A hand-held power tool housing is disclosed. The housing includes a first housing part on the edge of which a first rebate is formed and a second housing part on the edge of which a second rebate is formed. The first rebate and the second rebate are formed in a complementary manner to one another such that the first housing part and the second housing part can be assembled in an assembly direction. A groove is formed on the edge of the first housing part and a spring is formed on the edge of the second housing part, forming an interlocking groove-spring connection in a transverse direction to the assembly direction.

12 Claims, 4 Drawing Sheets

(58) Field of Classification Search
CPC .... B29C 66/1222; B29C 66/303; F16J 15/02; F16J 15/04; F16J 15/06; B65D 11/20
USPC ..... 173/171; 220/667; 310/89
See application file for complete search history.

(56) References Cited

U.S. PATENT DOCUMENTS

| | | | | |
|---|---|---|---|---|
| 7,625,209 | B2 * | 12/2009 | Wade | A61C 1/16 408/56 |
| 2005/0229398 | A1 * | 10/2005 | Leventhal | B26B 19/00 30/34.1 |
| 2008/0093369 | A1 * | 4/2008 | Delopst | A47J 43/07 220/677 |
| 2010/0024183 | A1 * | 2/2010 | Cuprys | B25B 27/02 29/270 |
| 2012/0152068 | A1 | 6/2012 | Liu | |
| 2013/0081838 | A1 | 4/2013 | Tully | |
| 2014/0299345 | A1 * | 10/2014 | McRoberts | B24B 23/043 173/162.2 |

FOREIGN PATENT DOCUMENTS

| | | | |
|---|---|---|---|
| DE | 10 2013 202 160 | A1 | 8/2014 |
| JP | 2002-254240 | A | 9/2002 |
| WO | WO 01/51256 | A1 | 7/2001 |

* cited by examiner

HAND-HELD POWER TOOL HOUSING

This application claims the priority of International Application No. PCT/EP2016/061398, filed May 20, 2016, and European Patent Document No. 15169325.6, filed May 27, 2015, the disclosures of which are expressly incorporated by reference herein.

BACKGROUND AND SUMMARY OF THE INVENTION

The invention concerns a hand-held power tool housing comprising a first housing part on the edge of which a first rebate is formed and comprising a second housing part on the edge of which a second rebate is formed. The first rebate and the second rebate are formed in a complementary manner, such that the first housing part and the second housing part can be assembled in an assembly direction. Such hand-held power tools are in principle known from the prior art and are used for hand-held power tools such as combined hammers or hammer drills.

The aim of the present invention is to disclose a hand-held power tool housing of which the first and second housing part can be assembled securely, wherein the hand-held power tool housing can be prepared in a particularly material-saving way.

This aim is achieved by a hand-held power tool housing of the type described above by a groove being formed on the edge of the first housing part and a spring being formed on the edge of the second housing part, forming a form-fitting groove-spring connection in a transverse direction to the assembly direction. It is particularly preferable for the groove-spring connection to be formfitting perpendicular to the assembly direction and/or in the longitudinal extension direction of the edge.

The invention comprises the knowledge that hand-held power tool housings are typically made of plastic, especially using injection molding procedures, which can cause warpage and shrinkage of the housing parts. Because of this the housing parts of the hand-held power tool housing are sometimes not dimensionally stable. The invention also comprises the knowledge that in hand-held power tool housings known from the prior art, a connection between the first rebate and the second rebate must typically be stabilized by internal reinforcing stays and/or reinforcing bars. One disadvantage of this is that material accrues in the region of the rebate pair, which leads to collapse points such as leaks in the exterior of the hand-held power tool housing. Another is that the reinforcing stays or reinforcing bars typical in the prior art have a low strength, as they are typically made very thin in order to save on materials. Another disadvantage of hand-held power tool housings in the prior art can be identified in that the reinforcing stays or reinforcing bars create an interfering geometry that negatively influences a ventilation flow from a provided cooling ventilator by creating unwanted air turbulence.

To avoid this, the invention provides for a groove-spring connection in addition to the rebate connection realized by the first and the second rebate which allows the reinforcing stays and reinforcing bars just described to be omitted, i.e., saves material and is simultaneously particularly stable.

In a particularly preferred embodiment, the groove is arranged in the section of the first rebate that is longer in the assembly direction. The spring can be arranged in the section of the second rebate that is shorter in the assembly direction. It has proven to be advantageous if the groove and the spring are configured on the respective edges of the housing parts in such a way that they are not visible from outside the housing when the first housing part and the second housing part are assembled.

The groove can form a first auxiliary rebate together with the longer section of the first rebate. Likewise, the spring can form a second auxiliary rebate together with a section of the second rebate that is longer in the assembly direction. The first auxiliary rebate and the second auxiliary rebate are preferably configured to be complementary to each other. This is advantageous because it results in a particularly secure fit of the first and second housing parts in the assembled state.

In a particularly preferred embodiment, the groove and/or the spring have a height-width ratio between 1:1 and 1:3. A height-width ratio is preferably about 1:2. Height here means the extension of the groove and/or the spring parallel to the assembly direction. Width here means the extension of the groove and/or the spring transverse to the assembly direction, especially perpendicular to the assembly direction and in the longitudinal extension direction of the edge.

It has proven to be advantageous if the groove and/or the spring have a height of about 2 mm and a width of about 5 mm. The spring preferably has rounded or slanted corners to facilitate introduction of the spring into the groove during assembly of the first and second housing parts.

The height of the groove and/or the height of the spring is preferably greater than the rebate height of the first and/or second rebate in the assembly direction.

The first auxiliary rebate preferably has a greater rebate height, preferably in the assembly direction, than the first rebate and/or the second auxiliary rebate has a greater rebate height, preferably in the assembly direction, than the second rebate.

In another preferred embodiment, at least one groove-spring connection is formed on the edge of the first housing part and on the edge of the second housing part. The additional groove-spring connection or the additional groove-spring connections are preferably spaced away from the first groove-spring connection along the edges.

The first rebate and the second rebate can be designed such that they form a separate groove-spring connection.

It has proven to be advantageous if the first housing part and/or the second housing part is free of reinforcing stays and/or reinforcing bars, preferably free of such as protrude out from a surface of the first housing part and/or the second housing part of which the normal to the plane is oriented transverse to the assembly direction and/or extend freely over the edges.

The hand-held power tool housing preferably consists of plastic and can be manufactured by injection molding. In a particularly preferred embodiment, the first housing part is a housing top section and the second housing part is a housing bottom section. The hand-held power tool housing is preferably included by a hand-held power tool.

Other advantages are shown in the following description of the figures. The figures depict a preferred exemplary embodiment of the present invention. The figures, the description, and the claims contain numerous features in combination. The person skilled in the art will also consider the features individually as appropriate and bring them together in meaningful additional combinations.

The figures number identical and equivalent components with identical reference symbols.

DETAILED DESCRIPTION OF THE DRAWINGS

Figure 1:
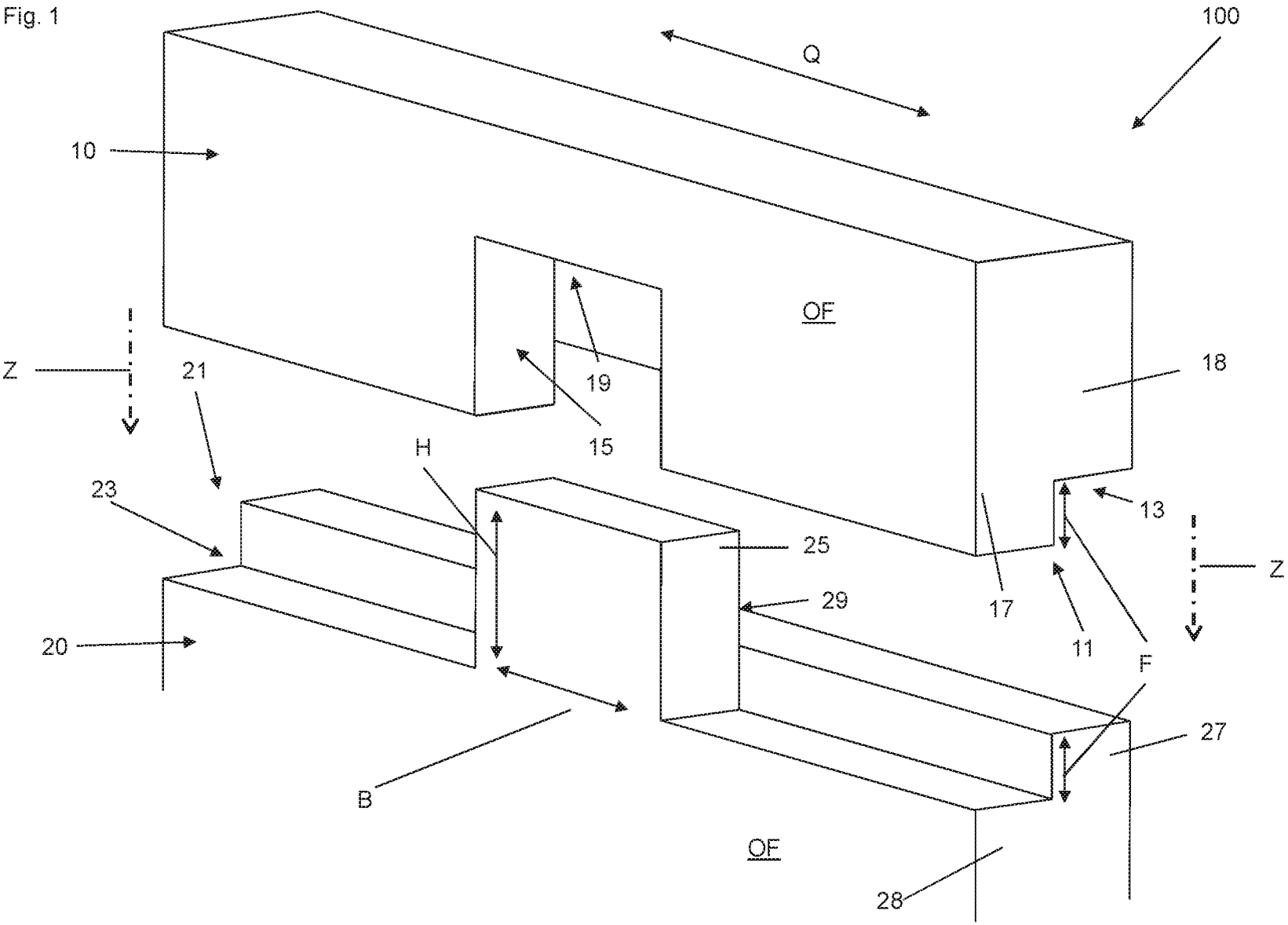
FIG. 1 illustrates a preferred exemplary embodiment of a hand-held power tool housing.

Sections of a hand-held power tool housing 100 are shown in FIG. 1, The hand-held power tool housing 100 comprises a first housing part 10 and a second housing part 20. In the present case, the first housing part 10 is a housing top section and the second housing part 20 is a housing bottom section. The first housing part 10 comprises an edge 11 that faces downwards in the depicted exemplary embodiment. A rebate 13 is formed on the edge 11 of the first housing part 10. A second rebate 23 is formed on the edge 21 of the second housing part. The edge 21 of the second rebate 23 faces upwards in the depicted embodiment. The first rebate 13 and the second rebate 23 are formed in a complementary manner. In this way the first housing part 10 and the second housing part 20 can be assembled in an assembly direction Z.

A groove 15 is formed on the edge 11 of the first housing part 10. A spring 25 is formed on the edge 21 of the second housing part 20. Groove 15 and spring 25 form a groove-spring connection. The groove-spring connection 15, 25 is formfitting transverse to the assembly direction Z. The transverse direction Q, indicated by the arrow, in this case faces perpendicular to the assembly direction Z. In other words, the first housing part 10 and the second housing part 20 cannot be displaced relative to each other in the transverse direction Q when assembled.

The height H of the groove 15 and the spring 25 is greater than the rebate height F of the first rebate 13 and the second rebate 23 in the assembly direction Z.

As can be seen from FIG. 1, the groove 15 is configured on the section 17 of the rebate 13 that is longer in the assembly direction Z. The shorter section 18 of the first rebate 13 that lies next to the longer section 17 is in this case free of any groove. The spring 25 is configured in the section 28 of the second rebate 23 that is shorter in the assembly direction Z. More precisely, in the embodiment shown in this case the spring 25 is formed on the shorter section 28 of the second rebate 23. The longer section 27 of the second rebate 23 remains free of any spring in the assembly direction Z.

The groove 15 and the longer section 17 of the first rebate 13 together form a first auxiliary rebate 19. The spring 25 and a section 27 of the second rebate 23 that is longer in the assembly direction Z together form a second auxiliary rebate 29. The first auxiliary rebate 19 and the second auxiliary rebate 29 are formed in a complementary manner, leading to a particularly secure fit of the first housing part 10 and the second housing part 20.

In the embodiment depicted in FIG. 1, the groove 15 and the spring 25 have a height-width ratio of about 1:1, where the reference symbol H identifies the height of the groove 15 and/or the spring 25 that is oriented parallel to the assembly direction Z and where the reference symbol B identifies the width B of the groove 15 and/or the spring 25 that is oriented perpendicular to the assembly direction Z.

A surface OF of the first housing part 10 and the second housing part 20, which in the assembled state of the hand-held power tool housing 100 is oriented in the direction of the housing interior, is also identified in FIG. 1. The groove 15 and the spring 25 are accordingly arranged on the respective edges 11, 21 such that they are not visible from outside the hand-held power tool housing 100, i.e., in this case from behind, when the first housing part 10 and the second housing part 20 are assembled.

Figure 2:
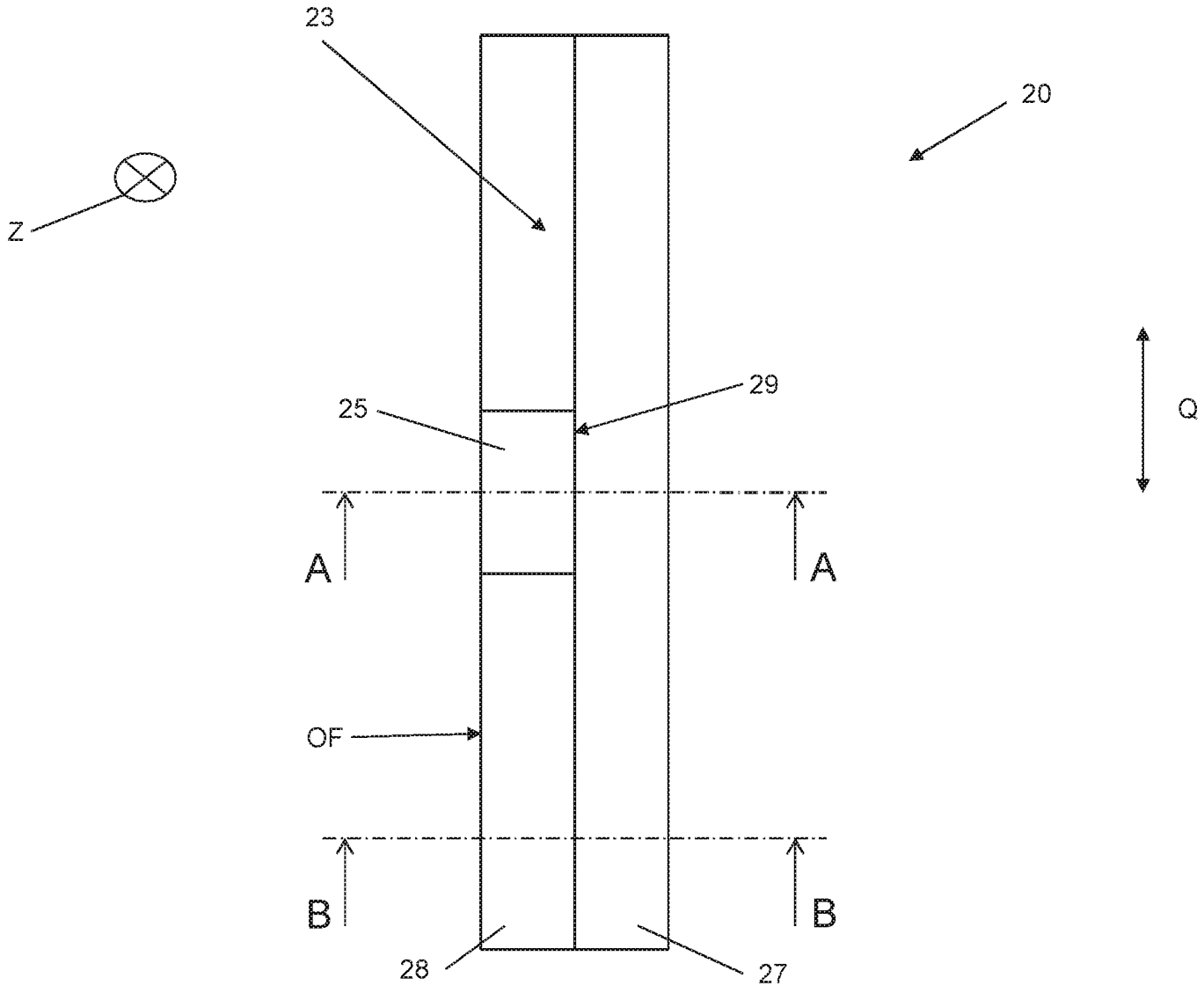
FIG. 2 is a top view of a second housing part of the hand-held power tool housing in FIG. 1, with sketched in section lines A-A and B-B.

FIG. 2 shows a top view of the second (bottom) housing part 20 depicted in FIG. 1. A section line A-A that runs through the spring 25 is shown perpendicular to the transverse direction Q. A section line B-B runs through a section of the second housing part 20 that is free of any spring. As can be seen in FIG. 2, the shorter section 28 of the second rebate 23 is equipped with the spring 25, while the longer section 27 of the second rebate 23 is without a spring. The second auxiliary rebate 29 is formed between the spring 25 and the section 27 of the second rebate 23 that is longer in the assembly direction Z (shown by an arrow pointing into the plane of the paper).

Figure 3:
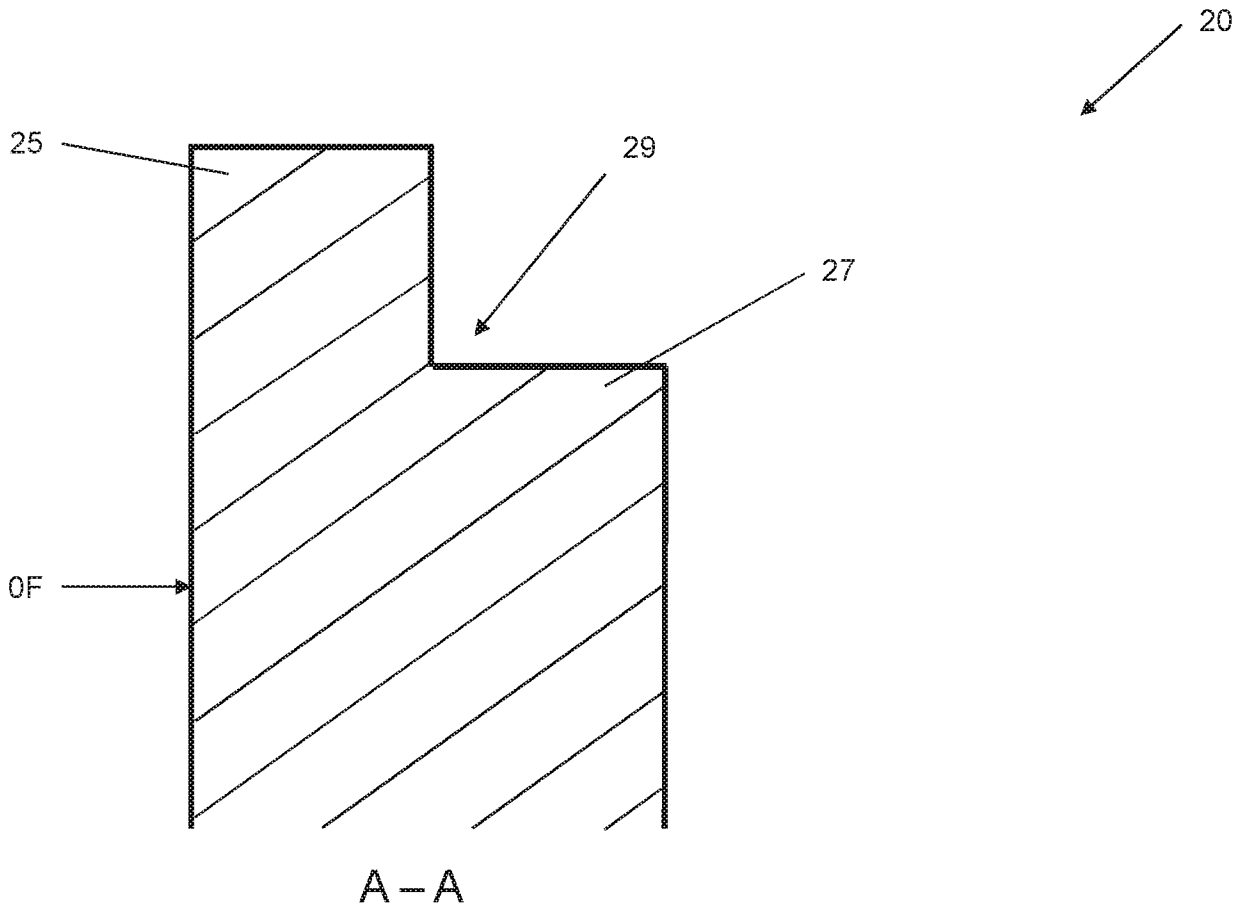
FIG. 3 is a section view A-A of the second housing part in FIG. 2.

FIG. 3 shows the section A-A of the second (bottom) housing part 20 in FIG. 2. As can be seen in FIG. 3, the second auxiliary, rebate 29 is formed to be equally long in regard to the spring 25 and the longer section 27.

Figure 4:
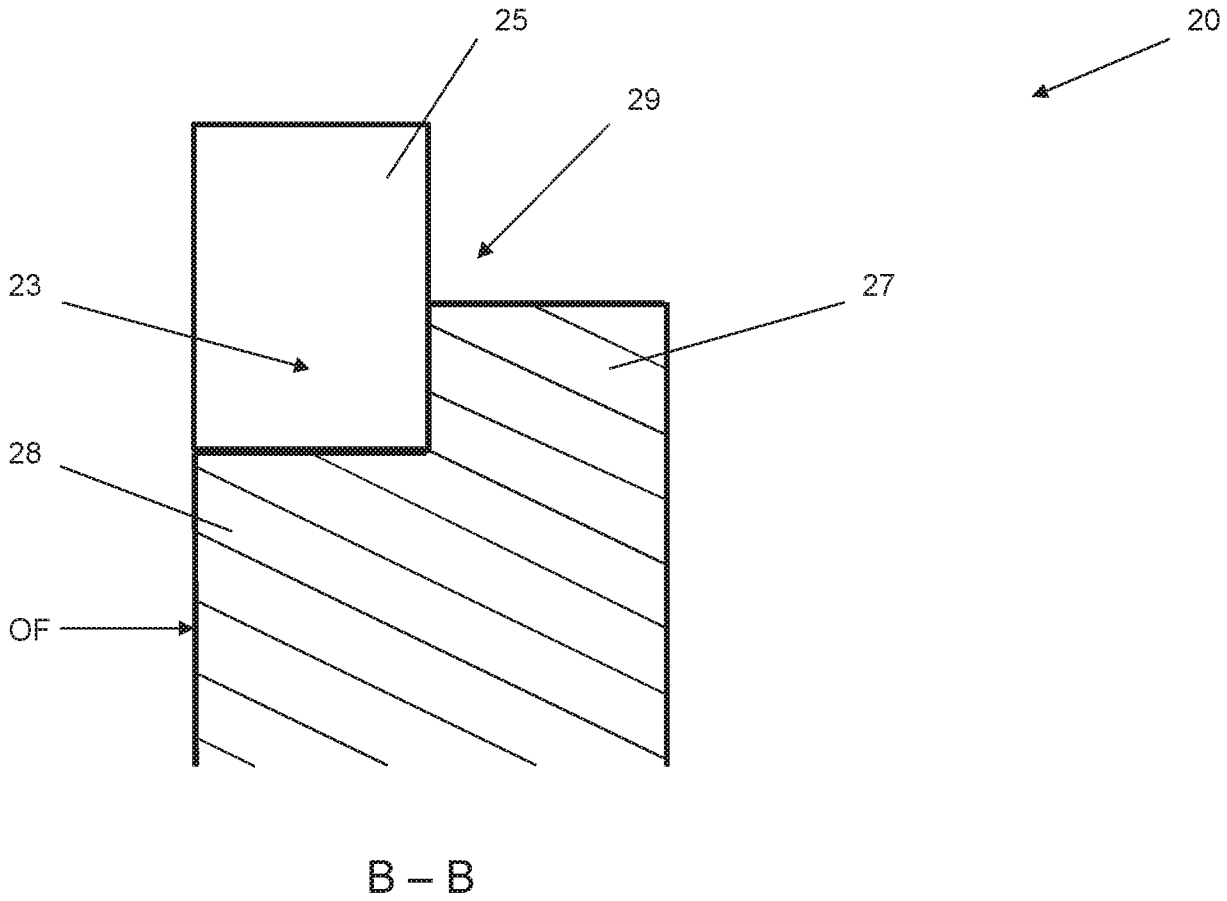
FIG. 4 is a section view B-B of the second housing part in FIG. 2.

FIG. 4 shows a section B-B of the second housing part 20 corresponding to the section line B-B sketched into FIG. 2. The second rebate 23 protrudes from the surface OF that is oriented towards the inside of the housing. The widths of the longer section 27 and the shorter section 28 of the second rebate 23 are about equal in the depicted example embodiment. The spring 25 extends over the full width of the shorter section 28 of the second rebate 23.

Viewing FIGS. 1 to 4 together shows that the groove 15 and the spring 25 are configured on the respective edges 11, 21 in such a way that the groove and the spring are not visible from outside the housing 100, i.e., from the side facing away from the surface OF, when the first housing part 10 and the second housing part 20 are assembled. Similarly, both the first housing part 10 and the second housing part 20 are free of reinforcing stays and reinforcing bars that protrude from the surface OF of the first housing part 10 and the second housing part 20. This is true in both the direction of the normal to the plane of the surface OF perpendicular to the assembly direction Z and in regard to extension over the edges 11, 21 parallel to the assembly direction Z. This is of course true with the exception of the invention's spring 25.

LIST OF REFERENCE CHARACTERS

10 First housing part
11 Edge of the first housing part
13 First rebate
15 Groove
17 Longer section of the first rebate
18 Shorter section of the first rebate
19 First auxiliary rebate
20 Second housing part
21 Edge of the second housing part
23 Second rebate
25 Spring
27 Longer section of the second rebate
28 Shorter section of the second rebate
29 Second auxiliary rebate
100 Hand-held power tool housing
B Width
F Rebate height
H Height OF Surface facing the inside of the housing
Q Transverse direction
Z Assembly direction
The invention claimed is:

1. A hand-held power tool housing, comprising:

a first housing part, wherein a first rebate is formed on an edge of the first housing part; and a second housing part, wherein a second rebate is formed on an edge of the second housing part;

wherein the first rebate and the second rebate are formed complementary to each other such that the first housing part and the second housing part are able to be assembled in an assembly direction;

wherein a groove is formed on the edge of the first housing part, wherein a spring is formed on the edge of the second housing part, and wherein the groove and the spring form a first groove-spring connection;

wherein the groove is disposed in a section of the first rebate that is longer in the assembly direction and/or the spring is disposed in a section of the second rebate that is shorter in the assembly direction;

wherein the groove and the section of the first rebate together form a first auxiliary rebate, wherein the spring and a section of the second rebate that is longer in the assembly direction together form a second auxiliary rebate, and wherein the first auxiliary rebate and the second auxiliary rebate are formed complementary to each other.

2. The hand-held power tool housing according to claim 1, wherein the groove and the spring are not visible from outside the hand-held power tool housing when the first housing part and the second housing part are assembled.

3. The hand-held power tool housing according to claim 1, wherein the groove and/or the spring have a height-width ratio between 1:1 and 1:3.

4. The hand-held power tool housing according to claim 1, wherein the groove and/or the spring have a height of 2 mm and a width of 5 mm.

5. The hand-held power tool housing according to claim 1, wherein the spring has rounded or slanted edges.

6. The hand-held power tool housing according to claim 1, further comprising a second groove-spring connection formed on the edge of the first housing part and on the edge of the second housing part that is spaced away from the first groove-spring connection.

7. The hand-held power tool housing according to claim 1, wherein a height of the groove and/or of the spring is greater than a height of the first rebate and/or of the second rebate in the assembly direction.

8. The hand-held power tool housing according to claim 1, wherein the first housing part and/or the second housing part is free of reinforcing stays and/or reinforcing bars.

9. The hand-held power tool housing according to claim 8, wherein the first housing part and/or the second housing part is free of reinforcing stays and/or reinforcing bars that protrude from a surface of the first housing part and/or the second housing part.

10. The hand-held power tool housing according to claim 1, wherein the hand-held power tool housing is comprised of plastic.

11. The hand-held power tool housing according to claim 10, wherein the hand-held power tool housing is formed by injection molding.

12. The hand-held power tool housing according to claim 1, wherein the first housing part is a housing top section and the second housing part is a housing bottom section.

* * * * *